US006609898B1

(12) United States Patent
Bury

(10) Patent No.: US 6,609,898 B1
(45) Date of Patent: Aug. 26, 2003

(54) PROCESS AND DEVICE FOR PUMPING COMPRESSIBLE MATERIALS WITH REDUCED PRESSURE PULSATION

(75) Inventor: James L. Bury, Pleasant Prairie, WI (US)

(73) Assignee: Putzmeister Inc., Sturtevant, WI (US)

( * ) Notice: Subject to any disclaimer, the term of this patent is extended or adjusted under 35 U.S.C. 154(b) by 0 days.

(21) Appl. No.: 09/968,601

(22) Filed: Oct. 1, 2001

(51) Int. Cl.[7] ..... F04B 17/00; F04B 49/00

(52) U.S. Cl. ..... 417/347; 417/46; 417/900; 417/342; 417/401; 417/309

(58) Field of Search ..... 417/46, 900, 342, 417/347, 401, 390

(56) References Cited

U.S. PATENT DOCUMENTS 3,507,347 A * 4/1970 Bennett ..... 180/53.1
4,470,771 A * 9/1984 Hall et al. ..... 417/342
4,611,973 A * 9/1986 Birdwell ..... 417/342
4,615,491 A * 10/1986 Batch et al. ..... 241/37

* cited by examiner

*Primary Examiner*—Charles G. Freay
*Assistant Examiner*—Timothy P. Solak
(74) *Attorney, Agent, or Firm*—Andrus, Sceales, Starke & Sawall, LLP

(57) ABSTRACT

A hydraulic system for a reciprocating piston pump that includes an accumulator for producing a steady-pressure supply of compressible material to a distribution nozzle. The hydraulic system includes an adjustable means for constricting the flow of hydraulic fluid from the accumulator to the hydraulic system. The means for constricting the flow of hydraulic fluid allows the operator to compensate for the type of material being pumped, the vertical distance the material is being pumped, as well as the overall distance the material is being pumped in order to reduce or eliminate line surge. The means for restricting the flow from the accumulator preferably includes a needle valve that allows the operator to select the flow characteristic from the accumulator.

4 Claims, 1 Drawing Sheet

PROCESS AND DEVICE FOR PUMPING COMPRESSIBLE MATERIALS WITH REDUCED PRESSURE PULSATION

BACKGROUND OF THE INVENTION

The present invention relates to a method and apparatus for pumping compressible materials using a twin-cylinder, reciprocating piston pump. More specifically, the present invention relates to a hydraulic system for operating a reciprocating piston pump that includes an accumulator that produces a steady-pressure supply of compressible material to an application nozzle and has a device for compensating for the varying demands of the material being pumped and the job site being worked.

Fire proofing material is one example of a compressible material that is commercially pumped using a twin-cylinder, reciprocating piston pump. In a typical reciprocating piston pump, while one cylinder is drawing material from a holding hopper, the other cylinder is pushing the material out into a delivery line that eventually terminates, at a distribution nozzle. At the distribution nozzle, the material is sprayed with the assistance of a supply of compressed air.

As mentioned above, in twin-cylinder, reciprocating piston pumps, when the two pistons are near the end of their cycle, the pistons switch modes. For example, the first piston goes from the pumping mode to the material drawing mode, while the second piston goes from the material drawing mode to the pumping mode. During this transition, there is a decrease in the delivery line pressure. This decreased line pressure continues until the pumping cylinder reaches its operator-designated speed. The fluctuation in pumping pressure during the transition between the cylinders has the effect of creating a non-continuous flow through the distribution nozzle. This non-continuous flow is referred to as line surge, which is highly undesirable for the nozzle operator. Specifically, line surge can cause muscle fatigue in the nozzle operator and creates a loss of efficiency in the pumping system.

Line surge is amplified in vertical pumping of the compressible material due to the force of gravity. For example, when compressible material is pumped upward, gravity pulls the material back toward the pumping apparatus and away from the distribution nozzle. The amplification of the line surge is proportional to the vertical distance the material is being pumped.

In addition to the effect of gravity, when pumping compressible material, an additional factor affects the line surge. Specifically, the line surge is affected by the springy nature of the material being pumped, since the efforts to push the material through the initial stages of the delivery hose are dampened. The pumping force is dampened because the compressible material has a tendency to push back toward the pumping apparatus if the pressure is not kept constant. Furthermore, the design of the hydraulic system may not be optimized for the material, since the level of compressibility varies with the material being pumped. Currently, numerous types of compressible materials exist in today's market place.

Currently, material line surges are decreased by adding a pre-charged, gas-assisted accumulator into the hydraulic system for the reciprocating piston pump. When the hydraulic line pressure to the piston pump drops below the pre-charged accumulator pressure, the accumulator's volume of oil is released into the system to provide a "turbo" boost to the pump. When the hydraulic line pressure from the source pump ramps up to a pressure above the accumulator pressure, normal pumping resumes and the accumulator bladder is refilled.

Presently, the size and volume of the accumulator are selected such that the accumulator will decrease or eliminate the line surge at a specified set of job site conditions. Typically, the accumulator is selected based upon a worst-case scenario of long-distance vertical pumping, such as the top of a high rise building. Because of this bias toward a single operating condition, the pumping system has a pre-disposition toward increased line surges when pumping in other conditions different than the preset value.

In order to compensate for the preset site selection of the accumulator volume, pump operators compensate in one of two ways: 1) decrease the volume of material being pumped to less than the machine's full capacity or 2) run the material through extra lengths of coiled delivery line to simulate the long distance pumping environment. Although these two methods of operation reduce line surge, both of these adjustments increase capital costs, decrease efficiency and increase setup and cleanup times.

Therefore, it is an object of the present invention to provide a method and apparatus for pumping compressible materials that have varying degrees of compressibility, over infinitely-varying horizontal and vertical distances within the expected pumping capabilities of the apparatus. Further, it is an object of the present invention to provide such an apparatus and arrangement that utilizes a minimum number of components, thereby making the system cost-effective to manufacture, maintain and operate. Further, it is an object of the present invention to provide such an apparatus that will eliminate the need for the operator to take extraneous means or methods to control line surge at the distribution nozzle.

SUMMARY OF THE INVENTION

The present invention relates to a hydraulic system, including an accumulator, that produces a steady supply of compressible material to a distribution nozzle. Specifically, the present invention relates to a hydraulic system for use with a twin-cylinder, reciprocating piston pump that includes means for constricting the output of an accumulator to adjust for varying demands of the material being pumped and the job site being worked.

The hydraulic system of the present invention includes an accumulator that is positioned in the supply line leading from the hydraulic fluid pump to a control valve that directs the flow of hydraulic fluid to a pair of cylinders of the reciprocating piston pump. The accumulator includes means for constricting the flow of the stored hydraulic fluid from the accumulator to the pair of cylinders through the control valve. Specifically, the accumulator includes a needle valve that allows the operator to constrict the flow of hydraulic fluid from the accumulator based upon the material being pumped and the job site being worked. For example, the output flow of the accumulator can be restricted based upon the distance and height that the material is being pumped, as well as based upon the compressibility of the specific material being pumped.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

Figure 1:
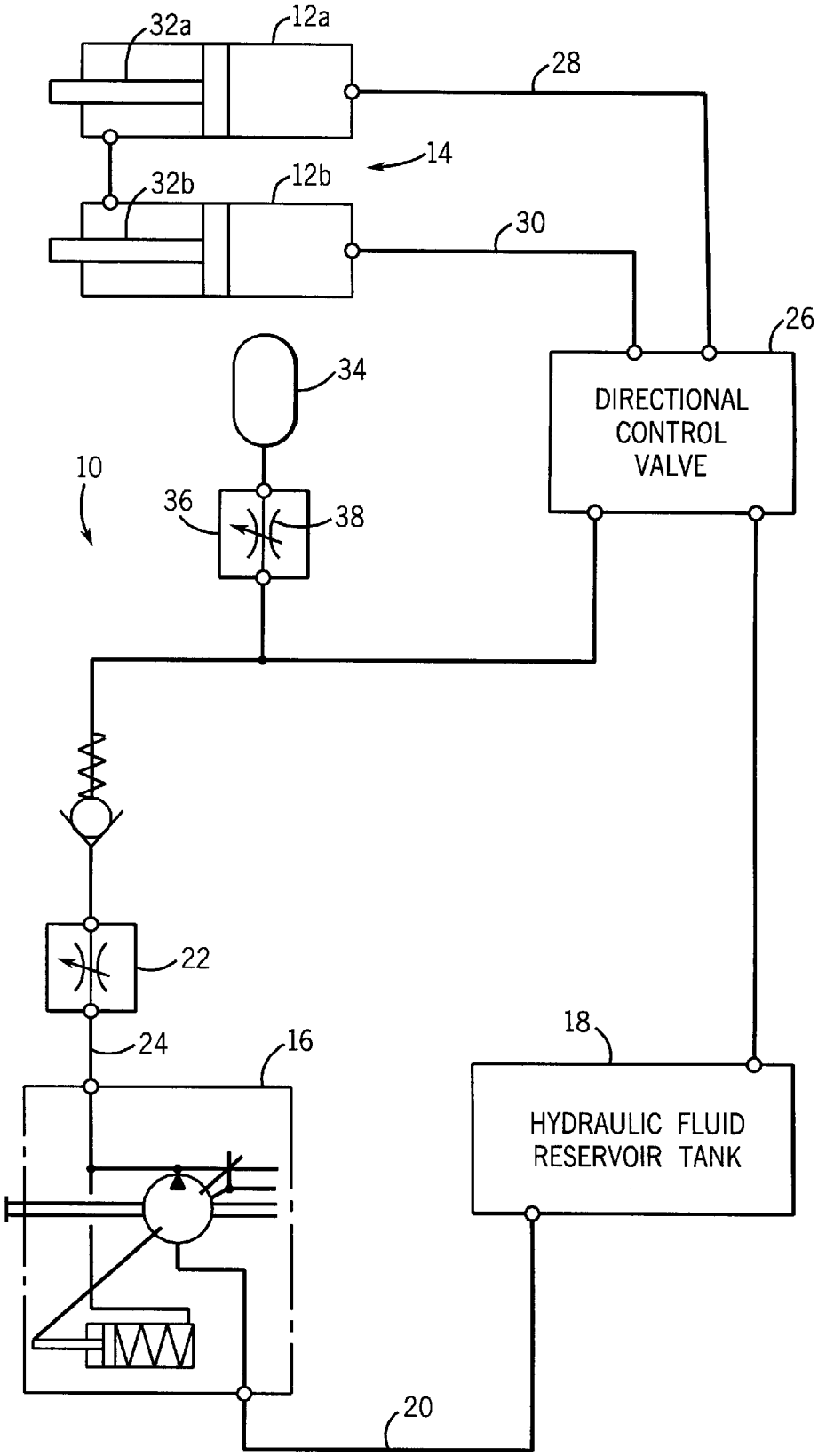

The sole drawing FIGURE is a schematics illustration of the hydraulic system used to operate a twin cylinder reciprocating piston pump including an accumulator and an accumulator adjustment means of the present invention.

DETAILED DESCRIPTION OF THE INVENTION

Referring first to the sole drawing FIGURE, thereshown is a schematic illustration of a hydraulic system 10 used to operate a pair of cylinders 12*a* and 12*b* of a twin-cylinder, reciprocating piston pump 14. The cylinders 12*a* and 12*b* feed a supply of material through a hose to a distribution nozzle, where the material is applied.

The hydraulic system 10 includes a variable displacement pump 16 that draws hydraulic fluid from a reservoir tank 18 through the supply line 20. The output of the variable displacement pump 16 flows through a volume control device 22 positioned in the outlet line 24 leading from the variable displacement pump 16. The volume control device 22 has the ability to allow the operator to restrict the amount of hydraulic oil being delivered to the control valve 26.

As can be seen in the sole drawing FIGURE, the directional control valve 26 is connected to cylinder 12*a* by a cylinder supply line 28 and is connected to the cylinder 12*b* by a second, cylinder supply line 30. The directional control valve 26 controls the flow of hydraulic oil to selectively move the pistons 32*a* and 32*b* of the reciprocating piston pump 14. Thus, the volume control device 22 allows the operator to restrict the amount of hydraulic oil being delivered to the control valve 26 and thus control the stroke speed of the pistons 32*a* and 32*b*, which in turn Although not shown in the sole drawing FIGURE, the control valve 26 directs the output of the variable displacement pump 16 to wherever an electronic control box of the hydraulic system 10 dictates. For example, the directional flow control valve 26 can direct the flow of hydraulic oil to the cylinder 12*a*, the cylinder 12*b*, or back to the reservoir tank 18.

The hydraulic system 10 further includes an accumulator 34 positioned in fluid communication with the outlet line 24 extending between the variable displacement pump 16 and the control valve 26. The accumulator 34 includes a fixed volume pressurized storage tank for a supply of hydraulic fluid. As shown in FIG. 1, a means 36 for constricting the flow out of the accumulator 34 is positioned between the accumulator 34 and the control valve 26. In the preferred embodiment of the invention, the means for constricting the flow from the accumulator 34 is a needle valve 38 that is infinitely adjustable within the valve's range from an open position to a closed position. The needle valve 38 can be adjusted to accurately restrict the hydraulic oil flow from the accumulator 34 to the cylinders 12*a* and 12*b*, depending upon various operating conditions for the reciprocating pump 14.

When the material cylinders 12*a* and 12*b* are stroking, the pressure in the hydraulic system 10 is fairly constant and near a preset level. By design, this hydraulic operating pressure is greater than the preset pressure charge created by the accumulator 34. Since the pressure in the outlet line 24 is greater than the pressure within the accumulator 34, the bladder in the accumulator 34 fills with oil until completely full.

When the material cylinders 12*a* and 12*b* reach their stroke end limits, various valves for the cylinders open and close and the pressure within the supply lines 28 and 30 temporarily decreases due to oil displacement. Since the pressure in the supply lines 28 and 30 falls, the pressure within the outlet line 24 falls below the pressure within the accumulator 34. When the pressure falls below that of the accumulator 34, hydraulic fluid flows out of the accumulator bladder and into the outlet line 24 leading to the control valve 26. The increase in the hydraulic pressure to each of the material cylinders 12*a* and 12*b* acts as an extra burst of fluid. The fluid released from the accumulator 34 reduces line surge by pre-compressing material in the cylinder 12*a* or 12*b* about to be pumped out. Further, the additional hydraulic fluid counteracts the back pressure associated with vertical pumping and keeps the cylinder heads moving for a faster ramp up to their desired pumping speed.

In prior art hydraulic systems for use with reciprocating piston pumps, the accumulator volume was selected to eliminate or reduce line surge when the material is being pumped at a preselected set of operating conditions. For example, the accumulator size may be selected to reduce line surge when the material is being pumped a maximum vertical distance in order to reduce line surge during this type of operation. Although a fixed volume accumulator works well when the reciprocating piston pump is being used at or near the design-for conditions, the fixed volume accumulator is not as effective at eliminating line surges during other operating conditions.

In order to compensate for the fixed volume accumulator, many operators utilize coiled distribution hoses in order to increase the effective length the compressible material is pumped prior to reaching the distribution nozzle. The coiled distribution hose simulates the type of operating conditions for which the accumulator was designed. This type of operation significantly decreases the operating efficiency of the reciprocating piston pump and increases the amount of setup and cleanup time required.

As discussed above, the means for constricting the output flow from the accumulator 34 allows the operator to adjust the operation of the accumulator 34 depending upon the particular situation in which the reciprocating piston pump 14 is being operated. For example, if the system is being used to pump material over a long vertical distance, the needle valve 38 can be fully opened to allow use of the entire accumulator volume. However, if the reciprocating piston pump 14 is being used to pump material over short horizontal distances, the needle valve 38 can be adjusted to restrict the amount of hydraulic fluid flow from the accumulator 34. In this manner, the operator of the variable displacement pump 14 including the hydraulic system 10 can adjust the system for the particular application.

In addition to compensating for the distance and vertical height the compressible material, is pumped, the needle valve 38 allows the operator to adjust the system for the type of compressible material being pumped. In this manner, the operator is able to adjust the needle valve 38 to decrease the line surge felt near the distribution nozzle.

Although the means for constricting the flow from the accumulator 34 is described and shown in the present invention as including a needle valve 38, it should be understood that various types of valving or flow restrictors could be used while operating within the scope of the invention. Specifically, the means for constricting the flow of the accumulator could be replaced by any mechanism that is operable to selectively control the flow of fluid through an outlet line.

Various alternatives and embodiments are contemplated as being within the scope of the following claims particularly pointing out and distinctly claiming the subject matter regarded as the invention.

I claim:

1. A method of reducing line surge in a twin cylinder reciprocating piston pump used to pump compressible material, the reciprocating piston pump being driven by a hydraulic system, the method comprising the steps of:

positioning an accumulator between a hydraulic fluid pump of the hydraulic system and the reciprocating piston pump, the accumulator including a volume of hydraulic fluid;

positioning a flow control valve between the accumulator and an outlet line supplying hydraulic fluid to the reciprocating piston pump; and adjusting the flow control valve to selectively control the output from the accumulator, the output from the flow control valve being selected to reduce line surge.

2. The method of claim 1 further comprising the step of adjusting the output from the flow control valve based upon the type of compressible material being pumped.

3. The method of claim 1 further comprising the step of adjusting the output of the flow control valve based upon the distance the material is being pumped.

4. The method of claim 1 wherein the flow control valve is infinitely adjustable within a valve range from an open position to a closed position.

* * * * *